US008480352B2

(12) United States Patent
Zheng et al.

(10) Patent No.: US 8,480,352 B2
(45) Date of Patent: Jul. 9, 2013

(54) SYSTEM FOR CONTROLLING THRUST IN STEAM TURBINE

(75) Inventors: Xiaoqing Zheng, Niskayuna, NY (US); Bernard Arthur Couture, Jr., Schenectady, NY (US); Casey William Jones, Malta, NY (US); Binayak Roy, Guilderland, NY (US)

(73) Assignee: General Electric Company, Schenectady, NY (US)

( * ) Notice: Subject to any disclaimer, the term of this patent is extended or adjusted under 35 U.S.C. 154(b) by 534 days.

(21) Appl. No.: 12/821,386

(22) Filed: Jun. 23, 2010

(65) Prior Publication Data

US 2011/0314817 A1 Dec. 29, 2011

(51) Int. Cl.
*F01D 3/00* (2006.01)
*F04D 29/041* (2006.01)

(52) U.S. Cl.
USPC ..... 415/104; 415/111; 415/112; 415/113

(58) Field of Classification Search
USPC ..... 415/14, 20, 21, 25, 26, 104, 105, 415/107, 111, 112, 113, 119; 60/660, 662, 60/663
See application file for complete search history.

(56) References Cited

U.S. PATENT DOCUMENTS 2,524,724 A * 10/1950 Zetterquist ..... 415/107
3,003,321 A * 10/1961 Warth ..... 60/688
3,565,543 A 4/1969 Mrazek
4,152,092 A 5/1979 Swearingen
4,557,664 A 12/1985 Tuttle et al.
6,957,945 B2 10/2005 Tong et al.
7,195,443 B2 3/2007 Vandervort et al.
2004/0101395 A1 * 5/2004 Tong et al. ..... 415/1
2008/0019821 A1 * 1/2008 Narita et al. ..... 415/103

OTHER PUBLICATIONS

Jagoda: U.S. Appl. No. 12/821,391, filed Jun. 23. 2010, Office Action 1 Jan. 22, 2013, 25 pages.

* cited by examiner

*Primary Examiner* — Nathaniel Wiehe
*Assistant Examiner* — Aaron Jagoda
(74) *Attorney, Agent, or Firm* — Ernest G. Cusick; Hoffman Warnick LLC

(57) ABSTRACT

A system controls net thrust of a steam turbine having a stepped rotating shaft. A first leak off line fluidly couples a first stage of a turbine section to a packing upstream of a stepped portion on the rotating shaft. A second leak off line fluidly couples a second stage of the turbine section that is subsequent to the first stage to a step area upstream of the stepped portion, and a connection line fluidly couples the first leak off line to the second leak off line. The lines include control valves such that a controller can actively control the net thrust by regulating thrust pressure on the stepped portion using steam from the first and second stages of the turbine section. The controller may also prevent damage to an active retractable seal using the control valves.

19 Claims, 2 Drawing Sheets

SYSTEM FOR CONTROLLING THRUST IN STEAM TURBINE

REFERENCE TO PRIOR RELATED APPLICATIONS

The current application is related to co-pending and commonly assigned U.S. patent application Ser. No. 12/821,391, filed on Jun. 23, 2010, entitled "System for Controlling Thrust In Steam Turbine", which is hereby incorporated herein by reference.

BACKGROUND OF THE INVENTION

The disclosure relates generally to steam turbines, and more particularly, to a system for controlling net thrust in a steam turbine to maintain thrust levels within an acceptable range of values, and avoid damage to the thrust bearing. The system may also prevent damage to an active retractable seal.

In a rotating turbomachine, thrust is an axial force acting on the rotating parts. Thrust is caused by unequal pressures acting over unequal surface areas, and changes in momentum of the fluid (steam) circulating through the machine. The sum of all axial forces acting on the rotating components of the turbine is referred to as "net thrust". This net thrust is typically transmitted to a stationary thrust bearing which, in turn, is anchored to a foundation for the steam turbine. The thrust developed by the steam turbine has two components. First, stage thrust is thrust resulting from the pressure distribution around a stage bucket (blade), a cover, a wheel, etc. Stage thrust is usually in the direction of steam flow. Second, step thrust results from variations in the diameter of the rotating shaft to which the buckets are mounted, and the local pressure at points along the length of the steam turbine.

Conventional methods for controlling thrust in a steam turbine include: 1) using a balance piston at the high pressure (HP) section, 2) varying the rotor diameter in each section, 3) varying the number of stages comprising each section, and 4) establishing an appropriate configuration for each of the low pressure (LP), intermediate pressure (IP), and high pressure (HP) sections of the steam turbine. However, most currently available methods only control thrust under "normal" operating conditions. As an engine design is completed, and its operating conditions are fixed, the net thrust of the steam turbine is specified, and typically cannot be adjusted dynamically or actively, either under normal conditions or during extreme, perhaps fault-related, operating conditions.

There are a number of extreme operating conditions that have the potential to create large thrust forces. Examples include but are not limited to: intercept valve closed condition, a trip condition in which all steam flow stops, use of maximum pressure steam in the high pressure turbine when extraction of steam from the high pressure turbine does not dump back into the steam turbine. As a result of the above situation, thrust bearings must be sized to accommodate all of the different operating conditions, even the rare, extreme thrust operating conditions. Building a thrust bearing to address rare operating conditions increases costs and creates power losses. If the thrust bearings are not configured to accommodate all extreme thrust operating conditions, then the steam turbine cannot operate at those conditions, which may result in failure to capture an optimum value-to-cost ratio. Prior approaches to address this situation include tapping into a steam inlet bowl pressure or damping pressure to a low-pressure region to offset thrust. Unfortunately, these methods are not capable of offsetting large amounts of thrust without wasting large amounts of steam, which also greatly decreases performance.

Another challenge is protection of seals during transient conditions. To avoid rubbing of seal teeth and degradation of sealing functions during a transient, such as passing a critical speed of the rotor, seals can be retracted via a spring bias, and then closed by pressure once a steady state operating condition is reached. Most designs include a passive retractable seal, activated by available operating pressure in the system. A more advanced design is referred to as an active retractable seal (ARS), in which a bypass valve is used to actively control the opening and closing of the seal on demand. The ARS is opened as long as the turbine does not reach a stable operating condition, and closed at a time when the turbine efficiency is the concern. If a high-level vibration, over-speed or any abnormal operation is detected, the seal can be retracted instead of waiting for the system pressure drop. Therefore, seals are protected from rubbing and sustainable performance can be obtained. The ARS ring may consist of multiple arcuate segments. The open (retracting) and close may be limited to some segments while the rest is biased to close all the time.

BRIEF DESCRIPTION OF THE INVENTION

A first aspect of the disclosure provides a system for controlling a net thrust of a steam turbine having a rotating shaft, the system comprising: an active-retractable seal (ARS) for sealing against the rotating shaft adjacent to a stepped portion on the rotating shaft in a turbine section; a first leak off line fluidly coupling a first stage of the turbine section to a packing area upstream of the ARS, the first leak off line including a first control valve and a second control valve; a second leak off line fluidly coupling a second stage of the turbine section that is subsequent to the first stage to a step area immediately upstream of the stepped portion, the second leak off line including a third control valve; a connection line fluidly coupling the first leak off line, between the first and second control valves, to the second leak off line, the connection line including a fourth control valve; and a controller configured to actively control the control valves to control the net thrust by regulating thrust pressure on the stepped portion.

A second aspect of the disclosure provides a system for controlling a net thrust of a steam turbine having a rotating shaft, the system comprising: a first leak off line fluidly coupling a first stage of a turbine section to a packing upstream of a stepped portion on the rotating shaft, the first leak off line including a first control valve and a second control valve; a second leak off line fluidly coupling a second stage of the turbine section that is subsequent to the first stage to a step area immediately upstream of the stepped portion, the second leak off line including a third control valve; a connection line fluidly coupling the first leak off line, between the first and second control valves, to the second leak off line, the connection line including a fourth control valve; and a controller configured to actively control the control valves to control the net thrust by regulating thrust pressure on the stepped portion using steam from the first and second stages of the turbine section.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

In accordance with embodiments of the present invention, a system is described for controlling the net thrust of a steam turbine by regulating thrust pressure across a stepped portion of a rotating shaft in a high pressure turbine section of the steam turbine, thus allowing use of a smaller thrust bearing. The system provides this functioning using steam leaked from the turbine section to which it is applied and without requiring additional steam or tapping into the main steam supply. The system may also allow retraction of an active retractable seal (ARS) during severe operating conditions. That is, the net thrust is controlled without compromising operation of the ARS, which means either before or after thrust is altered, the ARS can be set to close and open as desired. This aspect improves efficiency. Further, when the ARS is switching status, such as from either open to close, or close to open, the thrust is not affected. This aspect improves turbine operability since a sudden change in thrust balance in the middle of turbine tripping or shutdown is undesirable when the ARS is being retracted to avoid a rub.

Figure 1:
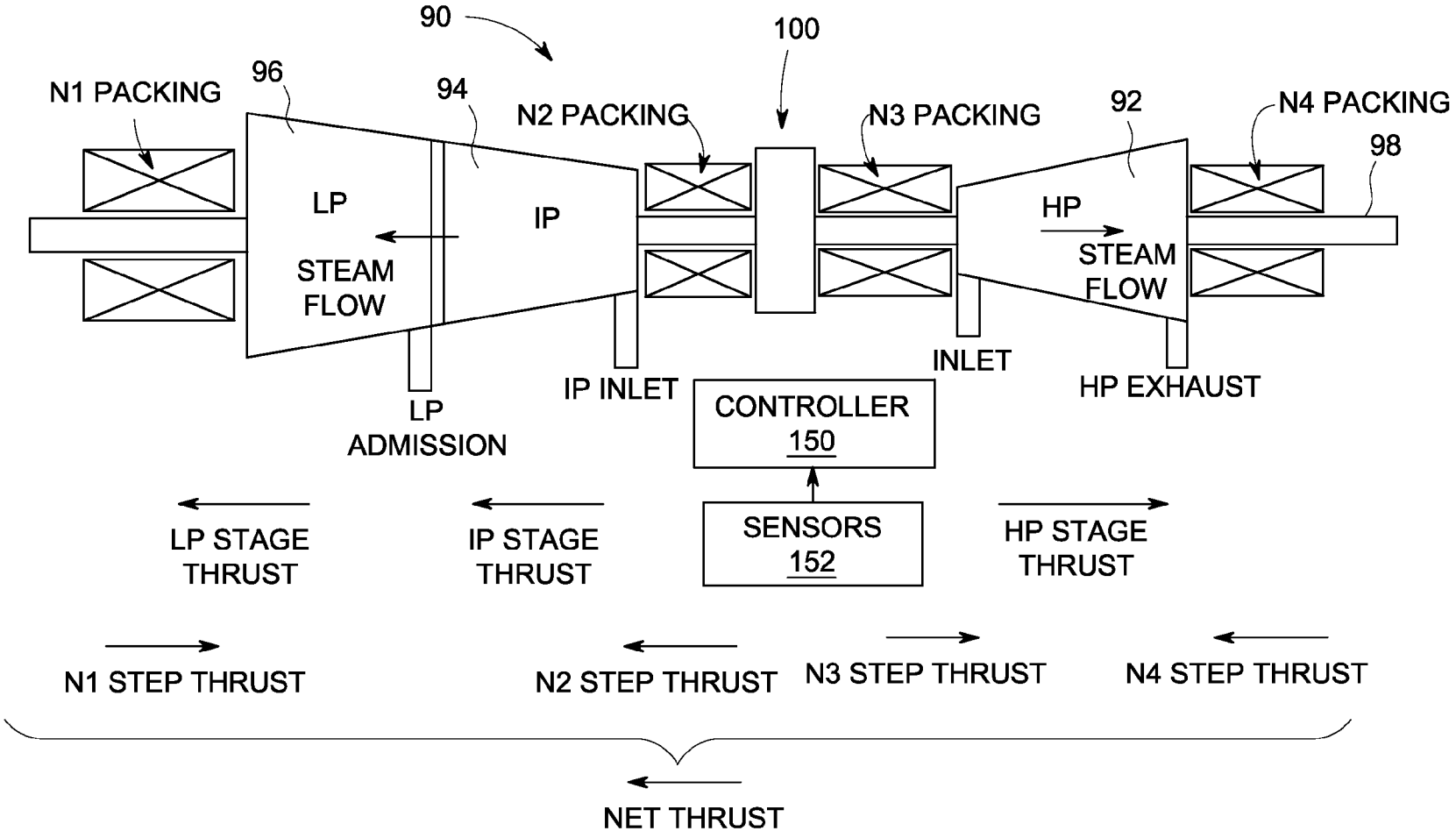
FIG. 1 is a schematic side view of a steam turbine.

Referring to FIG. 1, a steam turbine 90 is shown to include a high pressure (HP) turbine section 92, an intermediate pressure (IP) turbine section 94, and an adjacent low pressure (LP) turbine section 96. Each section may be comprised of one or more stages. The rotating elements housed within these various stages are commonly mounted on an axial rotating shaft (or rotor) 98. As shown in FIG. 1, HP turbine section 92 is arranged opposite to intermediate and low pressure turbine sections 94, 96 of steam turbine 90. This arrangement balances stage thrusts. Further, a thrust bearing 100 is installed between HP and IP sections 92, 94. The size (area) of thrust bearing 100 is selected to ensure that under a wide range of operating conditions (e.g., the turbine system's load, operating speed, temperature, and pressure levels within the steam turbine, etc.), the thrust pressure will fall within a predetermined range of values.

For steam turbine 90 of FIG. 1, stage thrusts are usually decided by flow path design based on aerodynamics, mechanics and efficiency considerations. Therefore, thrust balancing is normally done through step thrust in end packing areas. Step thrust is primarily developed in four packing regions: a packing N1 at the downstream end of LP turbine section 96, a packing N2 at the upstream end of IP turbine section 94, and packings N3 and N4 at the respective upstream and downstream ends of HP turbine section 92. The packings (or steam seals) are typically labyrinth type seals as is well known in the art, although other types of seals can be used. Each packing for a particular section of steam turbine 90 may include a number of sealing elements such as labyrinth seals.

The step thrusts produced in IP and LP sections 94, 96 are relatively small because the pressures in these sections are relatively low (e.g., from sub-ambient (vacuum) pressure to about 4,800 Pa (~0.7 psi) in section LP, up to about 24,000 Pa (~0.35 psi) in section IP). The largest step thrust occurs in an HP inlet packing (N3 in FIG. 1) due to the high pressure at this section. Step thrust at packing N4 is subject to a similar level of thrust because the diameter of rotating shaft 98 may sharply decrease at the transition from a last stage of HP turbine section 92 to packing N4. Because net thrust can build up to levels beyond the capability of thrust bearing 100, the step thrust present at a specified location within steam turbine 90 has been used to equalize the thrust differential across rotating shaft 98. This allows thrust bearing 100 to be of a reasonable size.

In steam turbine 90, the packings N1-N4 work either as pressure packings to prevent higher pressure steam from leaking out of the turbine section into a drain port, or as a vacuum packing preventing air from leaking into steam turbine 90. As the operating load on steam turbine 90 increases, pressure in HP and IP turbine sections 92, 94, respectively, of steam turbine 90 increases. Packings at the ends of these sections (the packings N2-N4 shown in FIG. 1) now act as pressure packings. When steam turbine 90 is operating to cause gears to turn and a vacuum to be pulled, all of the packings (packings N1-N4) act as vacuum packings and function to minimize steam leakage loss.

Figure 2:
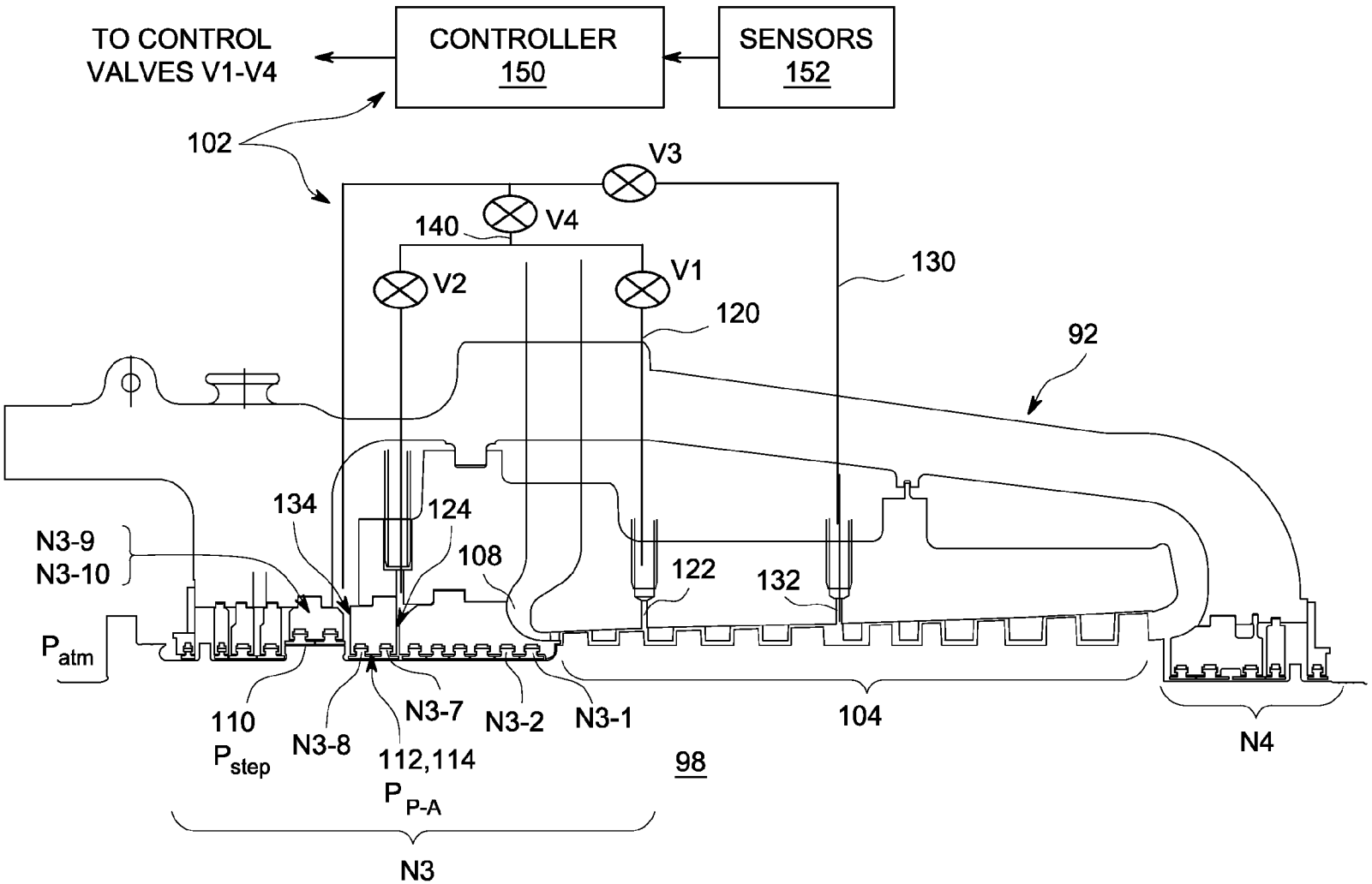
FIG. 2 shows a partial cross-sectional view of a high pressure turbine section including a net thrust control system according to embodiments of the invention.

Referring to FIG. 2, a partial cross-section of HP turbine section 92 is illustrated including a system 102 according to embodiments of the invention. Although system 102 will be described in conjunction with HP turbine section 92, it will be understood that the teachings of the invention may be applied to any turbine section. Rotating shaft 98 is shown at a bottom of FIG. 2 with a plurality of stages 104 extending therefrom in a known fashion. A high pressure inlet 108 for delivering steam to HP turbine section 92 has a general bowl shape. As leakage flow passes a component of a seal packing (e.g., packing N3-1), a pressure differential builds up across the packing element. For example, if steam turbine 90 has a bowl pressure $P_{bowl}$ of 13.3 MPa (1930 psi) at inlet 108, a pressure on the downstream side of packing element N3-1 may be, for example, approximately 12.7 MPa (~1842 psi). Similarly, the pressure on the downstream side of the next packing element N3-2 may be, for example, 12 MPa (~1740 psi). Those skilled in the art will further understand that a pressure on the downstream side of each packing element reflect similar changes in pressure through HP turbine section 92 of steam turbine 90. At the outlet end of the section, at the downstream side of packing N3, the pressure $P_{atm}$ reflects the pressure at a drain port.

FIG. 2 also shows a stepped portion 110 on rotating shaft 98. Conventionally, stepped portion 110 in HP turbine section 92 is used to control thrust of steam turbine 90 in conjunction with packings N-3 and N-4. A pair of seal packings N3-9 and N3-10 are illustrated sealing against stepped portion 110; however, more or less packings may be employed. It is understood that the location of stepped portion 110 may vary depending on a variety of factors, e.g., size of turbine, pressures used, number of preceding seal packings, etc.

System 102 may include a packing 112, which may take the form of an active-retractable seal (ARS) 114 in some embodiments, adjacent to stepped portion 110 to seal against rotating shaft 98 adjacent to stepped portion 114. As illustrated, packing 112 and ARS 114 include two seal packings N3-7, N3-8; however, more or less packings may be employed. In addition, the location of packing 112 and ARS 114 may vary depending on a variety of factors, e.g., size of turbine, pressures used, number of preceding seal packings, etc. ARS 114 may include any now or later developed active retractable seal that is spring-biased to an open, non-sealing position, but which spring-bias can be overcome by a pressure differential applied across ARS 114 to move seal packings thereof to a closed, sealing position (shown) at which ARS 114 seals against rotating shaft 98. Detailed configurations of ARS 114 are well known in the art, and are not further discussed herein.

FIG. 2 also shows system 102 including a first leak off line 120 fluidly coupling a first stage 122 of HP turbine section 92 to a packing area 124 upstream of packing 112 (and ARS 114, when employed) and upstream of stepped portion 110. A pressure at packing 112 or packing area 124 is indicated as $P_{P\text{-}A}$. In the example shown, first stage 122 is a second stage of HP turbine section 92. It is understood, however, that first stage 122 may be located at a different stage depending on the pressure required for the operations described elsewhere herein. First leak off line 120 includes a first control valve V1 and, in contrast to conventional systems, a second control valve V2. A second leak off line 130 fluidly couples a second stage 132 of steam turbine (HP) that is subsequent to first stage 122 (i.e., farther downstream) to a step area 134 immediately upstream of stepped portion 110. A pressure at step area 134 is indicated as $P_{step}$. In the example shown, second stage 132 is a fifth stage of HP turbine section 92. It is understood, however, that second stage 132 may be located at a different stage subsequent to first stage 122 depending on the pressure required for the operations described elsewhere herein. Second leak off line 130 also includes a third control valve V3.

System 102 also includes a connection line 140 fluidly coupling first leak off line 120, between first control valve V1 and second control valve V2, to second leak off line 130. As illustrated, connection line 140 includes a fourth control valve V4.

Control valves V1-V4 may include any now known or later developed valve capable of electronic control, e.g., a solenoid valve. As is well known in the art, solenoid valves are control devices used to automatically control pressures at packing components in steam turbine 90. When electrically opened or closed, control valves V1-V4 allow steam to either flow or stop.

Continuing with FIG. 2, system 102 also includes a controller 150 configured to actively control the control valves V1-V4 to regulate net thrust by regulating thrust pressure on stepped portion 110, using steam leaking through N3-1 to N3-6 from inlet bowl 108 and routing the leakage back to either first and second stages 122, 132 of HP turbine section 92 to have some more work done. As will be described further herein, controller 150 is also configured to allow retraction of ARS 114, where employed, during at least one of an extreme thrust operating condition and a severe operating condition. An "extreme thrust operating condition" may include any operating state that exhibits thrust levels for which a larger thrust bearing 100 would be required. Examples include but are not limited to: use of maximum steam pressure, steam extraction from steam turbine 90 (including initiation of steam extraction from steam turbine 90), or steam dumping. A "severe operating condition" may be any operating state that does not necessarily exhibit thrust levels as described above, but may require retraction of ARS 114 to prevent damage such as a startup or shutdown of steam turbine 90, a thermal transient or a tripping event due to vibration or over-speed of steam turbine 90, etc. A "steady-state operating condition" may be any operating state during which the turbine section is not transitioning or in a transient state. Similarly, a "non-steady state operating condition" may be any operating state during which a transition or transient, e.g., passing a critical speed of the rotor, etc., is occurring. It is understood that the above-described operating conditions may occur alone or together, or not at all. That is, non-extreme thrust, severe operating condition may exist, or an extreme thrust, non-severe operating condition may exist, each of which may occur during steady-state operation or non-steady-state operation. Although shown as a separate controller 150, it is understood that the controller can be integrated into an overall control system for steam turbine 90, e.g., as part of hardware and/or software thereof.

System 102 is capable of creating a number of control valve positions that accommodate a number of operating conditions of steam turbine 90. In general, system 102 adds an adjustable thrust balance function to stepped portion 110 and/or ARS 114 to bring the net thrust at an extreme thrust operating condition, such as maximum high pressure (MAX HP) with extraction or steam dumping, close to other operating points. These features reduce the necessary size of thrust bearing 100 and allow the above functioning on systems that were not designed for such high net thrusts. In addition, system 102 allows retraction of ARS 114 to prevent damage during severe operating conditions and/or extreme thrust operating conditions. A size of stepped portion 110, i.e., increased diameter compared to adjacent circumferences of stepped rotating shaft 98, is based on an amount of counter-thrust required during an extreme thrust operating condition. In one example, stepped portion 110 may have an increased diameter of approximately 15.24 centimeters (~6 inches) compared to adjacent portions of rotating shaft 98.

The different configurations that controller 150 of system 102 can provide to accommodate the different operating conditions will now be described. In a non-extreme thrust, non-severe, steady-state operating condition, controller 150 opens first, second and third control valves V1, V2, V3 and closes fourth control valve V4. This configuration is for operating conditions that would be considered to have non-problematic net thrust and non-severe operation to warrant retraction of ARS 114. In this configuration, first steam leak off line 120 fluidly couples first stage 122 to packing area 124 to control the pressure at packing area 124. If packings N3-1 to N3-6 are sealing relatively better than downstream packing (N3-7 and after), higher pressure steam may flow from first stage 122 to packing area 124 to build up a back pressure there to reduce leakage of high-energy steam from inlet bowl 108. In other situations, when the upstream packings are not sealing that well, i.e., the upstream leakage is more than the downstream leakage, the extra leakage from inlet bowl 108 is routed from packing area 124 back to first stage 122 to do more work. Either way, the pressure at packing area 124 is substantially the same as the pressure at first stage 122. Similarly, second steam leak off line 130 fluidly couples second stage 132 to step area 134 such that the pressure at step area 134 is substantially the same as the pressure at second stage 132. Connection line 140 is closed off by control valve V4. Essentially, the pressures at packing area 124 and step area 134 are stable as they are related to main flow pressure, and are not affected by sealing performance or seal degradation. Therefore, the thrust from stepped portion 110 is known and reliable. The net thrust (FIG. 1) can be controlled by exposing stepped portion 110 to either the pressure from first stage 122 or second stage 132. Where ARS 114 is provided, in this configuration, since area pressure $P_{P\text{-}A}$ is greater than step area pressure $P_{step}$, ARS 114 is maintained in a closed, sealing position with rotating shaft 98. That is, because the pressure at first stage 122 is sufficiently greater than the pressure at second stage 132 to overcome the retraction spring-based pressure of ARS 114, ARS 114 is maintained in a closed, sealing position with rotating shaft 98.

As noted above, a severe operating condition may occur during the above-described configuration by way of, for example, a turbine trip due to high level of vibration or overspeed, or a thermal transient during, for example, startup or shutdown of steam turbine 90. The severe operating condition may be one at which ARS 114, where provided, may require retraction to prevent packing seal teeth damage from rotor excursion and thermal pinching, but an extreme thrust imbalance is not present. In response to a non-extreme thrust, severe operating condition occurring or being created, controller 150 closes first control valve V1, and opens second, third and fourth control valves V2-V4. In this configuration, packing area 124 is fluidly coupled via first steam leak off line 120 (i.e., left side of line 120 as illustrated, prior to second control valve V2) to second leak off line 130, the latter of which also fluidly couples step area 134 to second stage 132. Consequently, packing area 124 is exposed to the same pressure as step area 134, i.e., $P_{step}=P_{P\text{-}A}$, and ARS 114 retracts away from rotating shaft 98, thus preventing damage to HP turbine section parts such as packings N3-7 and N3-8 and rotating shaft 98. It is noted that the operation of valves described above does not alter pressure at step area 134. Thus, no sudden thrust change would occur during the process to otherwise cause additional machine instability.

In another operational condition, HP turbine section 92 runs at an extreme thrust, steady-state operating condition. This operating condition creates a higher HP stage thrust (FIG. 1) than conditions with less steam pressure. In this case, controller 150 opens first and fourth control valves V1 and V4, and closes second and third control valves V2 and V3. In this configuration, first stage 122 is fluidly coupled to step area 134 such that higher pressure steam may flow from first stage 122 to step area 134. Also, packing area 124 is closed off from first leak off line 120 by second valve V2 being closed, and second stage 132 is closed off from second leak off line 130 by control valve V3 being closed. Since packing area 124 is no longer connected to any stage pressure, its pressure is now determined from the pressure distribution among packings N3-1 to N3-8 with the upstream pressure from inlet bowl 108 to a relatively lower downstream pressure at step area 134. There will be a pressure drop across each of those packings from the mass leakage balance. That is, the pressure prior to packing 112 is greater than the pressure $P_{P\text{-}A}$ at packing 112, and the pressure $P_{P\text{-}A}$ is greater than pressure $P_{step}$ before stepped portion 110. Therefore, ARS 114 remains closed, i.e., sealing against rotating shaft 98. Simultaneously, the increased step area pressure $P_{step}$ from first stage 122 provides counter thrust against stepped portion 110 to counter-act the higher HP stage thrust created by the maximum high pressure operating condition, thus controlling the net thrust.

As noted above, an extreme thrust operating condition may occur during the above-described configuration by way of, for example, the start of extraction of steam for other purposes from HP turbine section 92, resulting in an extreme thrust and severe operating condition. In this case, pressure before stepped portion 110 is set at a higher value to counter balance the increased net thrust as described above. To start the machine into such a thrust setting, or to shutdown from such a setting due to planned outrage or system trip, ARS 114 needs to be retracted to save the seal teeth from rubbing. In this case, controller 150 opens first, second and fourth control valves V1, V2 and V4 and closes third control valve V3. In this configuration, first stage 122 is fluidly coupled to step area 134 and packing area 124 such that respective pressures, i.e., $P_{P\text{-}A}$ and $P_{step}$, are substantially equal. Consequently, ARS 114 retracts away from rotating shaft 98, thus preventing damage to, for example, the HP turbine section 92 parts such as packings N3-7 and N3-8 and rotating shaft 98. Simultaneously, the increased step area pressure $P_{step}$ from first stage 122 continues to provide counter thrust against stepped portion 110 to counter-act the higher HP stage thrust created by the maximum high pressure operating condition, thus controlling the net thrust. It noted again that the operation of valves to open and close ARS 114 at an extreme thrust operating condition does not alter pressure at step area 134. Thus, no sudden thrust change would occur during the process to otherwise cause additional machine instability.

While not described in detail herein, it is understood that system 102 may cooperate with any number of now known or later developed sensors 152 to determine under what conditions steam turbine 90 is running. Sensors 152 may measure any of a number of operational parameters such as but not limited to: thrust on each side of thrust bearing 100, increased operating pressure in any of the turbine sections, changes in extraction conditions, e.g., opening of an extraction valve (not shown), onset of startup procedure, a system trip, onset of a shutdown procedure, etc.

As described above, a technical effect of controller 150 is that it controls net thrust on stepped rotating shaft 98 of HP turbine section 92 and retraction of ARS 114 that seals against stepped rotating shaft 98 using steam from a pair of leak off lines 120, 130 fluidly coupled to separate stages 122, 132 of HP turbine section 92. An advantage that may be realized in the practice of some embodiments of the described systems and techniques is the use of existing leak-off lines with additional lines and valving to alter pressure at a stepped portion 110 of a rotating shaft to offset thrust for one extreme thrust operating point, so that net thrust variations are reduced. In particular, the onset of extraction during maximum high pressure in HP turbine section 92 presents an rare (outlier) operating condition in terms of required strength for thrust bearing 100. System 102 allows for reduction of thrust bearing size and reduces power assumption (e.g., 300 KW in one situation) by countering net thrust for that particular and other extreme thrust operating points that typically dictate thrust bearing size. Consequently, system 102 may allow high pressure extraction for steam turbines 90 that were not designed for such operation. Furthermore, where employed, system 102 maintains the operability of ARS 114, i.e., it can be opened and closed as needed, with no net thrust change when the ARSs are either retracted or closed so that no additional disturbance is added when rotating shaft 98 is tripped.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A system for controlling a net thrust of a steam turbine having a rotating shaft, the system comprising:

an active-retractable seal (ARS) for sealing against the rotating shaft adjacent to a stepped portion on the rotating shaft in a turbine section;

a first leak off line fluidly coupling a first stage of the turbine section to a packing area upstream of the ARS, the first leak off line including a first control valve and a second control valve;

a second leak off line fluidly coupling a second stage of the turbine section that is subsequent to the first stage to a step area immediately upstream of the stepped portion, the second leak off line including a third control valve;

a connection line fluidly coupling the first leak off line to the second leak off line, wherein the connection line is coupled to the second leak off line downstream of the third control valve and is coupled to the first leak off line between the first control valve and the second control valve, and wherein the connection line includes a fourth control valve; and a controller configured to actively control the control valves to control the net thrust by regulating thrust pressure on the stepped portion.

2. The system of claim 1, wherein the controller is further configured to actively control the control valves to control net thrust by regulating thrust pressure on the stepped portion while allowing retraction of the ARS during at least one of an extreme thrust operating condition or a severe operating condition.

3. The system of claim 2, wherein the extreme thrust operating condition is selected from the group consisting of: use of maximum steam pressure, steam extraction from the steam turbine, and steam dumping; and wherein the severe operation condition is selected from the group consisting of: a startup of the steam turbine, a shutdown of the steam turbine, a thermal transient, and a tripping event of the steam turbine.

4. The system of claim 2, wherein in a non-extreme thrust, non-severe, steady-state operating condition, the controller opens the first, second and third control valves and closes the fourth control valve.

5. The system of claim 4, wherein in response to a non-extreme thrust, severe operating condition occurring, the controller closes the first control valve, and opens the second, third and fourth control valves.

6. The system of claim 2, wherein in an extreme thrust, steady-state operating condition, the controller opens the first and fourth control valves and closes the second and third control valves.

7. The system of claim 6, wherein in response to an extreme thrust and severe operating condition occurring, the controller opens the first, second and fourth control valves and closes the third control valve.

8. The system of claim 2, wherein a size of the stepped portion is based on an amount of counter-thrust required during the extreme thrust operating condition.

9. The system of claim 1, further comprising a thrust bearing positioned to receive the net thrust exerted by the rotating shaft.

10. The system of claim 9, wherein the turbine section includes a high pressure (HP) turbine section, and the thrust bearing is positioned between the HP turbine section and at least one of a low pressure (LP) turbine section and an intermediate pressure (IP) turbine section of the steam turbine.

11. A system for controlling a net thrust of a steam turbine having a rotating shaft, the system comprising:

a first leak off line fluidly coupling a first stage of a turbine section to a packing area upstream of a stepped portion on the rotating shaft, the first leak off line including a first control valve and a second control valve;

a second leak off line fluidly coupling a second stage of the turbine section that is subsequent to the first stage to a step area immediately upstream of the stepped portion, the second leak off line including a third control valve;

a connection line fluidly coupling the first leak off line to the second leak off line, wherein the connection line is coupled to the second leak off line downstream of the third control valve and is coupled to the first leak off line between the first control valve and the second control valve, and wherein the connection line includes a fourth control valve; and a controller configured to actively control the control valves to control the net thrust by regulating thrust pressure on the stepped portion using steam from the first and second stages of the turbine section.

12. The system of claim 11, wherein the packing includes an active-retractable seal (ARS) for sealing against the rotating shaft adjacent to the stepped portion, and wherein the controller is further configured to actively control the control valves to regulate net thrust by controlling thrust pressure on the stepped portion while allowing retraction of the ARS during at least one of an extreme thrust operating condition and a severe operating condition.

13. The system of claim 12, wherein the extreme thrust operating condition is selected from the group consisting of: use of maximum steam pressure, steam extraction from the steam turbine, and steam dumping; and wherein the severe operation condition is selected from the group consisting of: a startup of the steam turbine, a shutdown of the steam turbine, a thermal transient, and a tripping event of the steam turbine.

14. The system of claim 12, wherein in a non-extreme thrust, steady-state operating condition, the controller opens the first, second and third control valves and closes the fourth control valve.

15. The system of claim 14, wherein in response to a non-extreme thrust, severe operating condition occurring, the controller closes the first control valve, and opens the second, third and fourth control valves.

16. The system of claim 12, wherein in an extreme thrust, steady-state operating condition, the controller opens the first and fourth control valves and closes the second and third control valves.

17. The system of claim 16, wherein in response to the extreme thrust and severe operating condition, the controller opens the first, second and fourth control valves and closes the third control valve.

18. The system of claim 12, wherein a size of the stepped portion is based on an amount of counter-thrust required during the extreme thrust operating condition.

19. The system of claim 12, further comprising a thrust bearing positioned to receive a net thrust exerted by the rotating shaft, and wherein the turbine section includes a high pressure (HP) turbine section, and the thrust bearing is positioned between the HP turbine section and at least one of a low pressure (LP) turbine section and an intermediate pressure (IP) turbine section of the steam turbine.

* * * * *